US005128641A

United States Patent [19]

Posey

[11] Patent Number: 5,128,641

[45] Date of Patent: Jul. 7, 1992

[54] MAGNETIC SWITCHES

[75] Inventor: William T. Posey, Rte. 1, Chickasha, Okla. 73018

[73] Assignee: Hermetic Switch, Inc., Chickasha, Okla.

[21] Appl. No.: 59,622

[22] Filed: Jun. 8, 1987

[51] Int. Cl.[5] ..... H01H 1/66

[52] U.S. Cl. ..... 335/151; 335/205; 335/207

[58] Field of Search ..... 335/205, 206, 207, 131, 335/133, 134

[56] References Cited

U.S. PATENT DOCUMENTS

| | | | |
|---|---|---|---|
| 3,205,323 | 9/1965 | Deshautreaux, Jr. | 200/87 |
| 3,560,846 | 2/1971 | Bessko | 324/41 |
| 3,967,224 | 6/1976 | Seeley | 335/151 |
| 4,038,620 | 7/1977 | Shlesinger, Jr. et al. | 335/153 |
| 4,038,926 | 8/1977 | Holberry | 335/207 |
| 4,039,985 | 8/1977 | Shlesinger, Jr. et al. | 335/153 |
| 4,210,888 | 7/1980 | Holce | 335/207 |
| 4,213,110 | 7/1980 | Holce | 335/207 |
| 4,271,763 | 6/1981 | Berger | 104/179 |

*Primary Examiner*—Lincoln Donovan

*Attorney, Agent, or Firm*—Laney, Dougherty, Hessin & Beavers

[57] ABSTRACT

Apparatus for proximity magnetic switching wherein magnet assemblies are used in combination with magnetic reed switches by placement of the reed switch axis in a magnetic field null position which is shifted or unbalanced by proximation of certain magnetic materials to actuate the magnetic reed switch. In particular, such proximity magnetic switch is made weather proof and entirely sealed from its environment by molding the magnet assembly and reed switch assembly in fixed orientation within a potted compound which then exposes an actuating surface for sensing the presence of a magnetically permeable material.

14 Claims, 4 Drawing Sheets

MAGNETIC SWITCHES

BACKGROUND OF THE INVENTION

1. Field of the Invention

The invention relates generally to magnetically actuated, hermetically sealed, reed-type switches of the type that is actuatable in response to proximity to a magnetizable or permeable material and which is particularly useful in providing a totally sealed, weatherproof switch.

2. Description of the Prior Art

The prior art includes a number of different types of magnetic proximity switch utilizing reed switches or similar contact configurations for actuation in response to a magnetic field. Early types of magnetic switch consisted of a pair of contacts formed of magnetic material and physically disposed relative to a magnet to achieve desired switch closure. U.S. Pat. No. 4,038,620 provides a representative showing of one type of magnetic switch wherein the reed contacts are disposed directly between two magnet materials and influenced by relative movement to open and close reed contacts. This type of switch is characterized by the use of multiple magnets relatively positioned to influence the reed contacts.

U.S. Pat. No. 3,560,846 teaches still another configuration of plural magnets as utilized in a balanced manner to influence the contacts of a reed switch. This switch functions as a proximity detector to effect switch closure by saturating a high permeability yoke and concentrating the magnetic flux field to close the reed contacts. U.S. Pat. No. 4,210,888 teaches a relatively basic form of proximity switch wherein the magnet portion of the switch is movably displaced for proximity actuation of the reed switch for either normally open or normally closed operation. Finally, the U.S. Pat. No. 3,205,323 teaches a proximity switch that utilizes a specially formed ceramic magnet that is laterally polarized and including a flux passage hole through the middle. Reed switch operation is effected by concentration or disbursement of the magnetic flux field through the contacts as the magnet elements are all disposed in balanced relationship thereto.

SUMMARY OF THE INVENTION

The present invention relates to an improved form of magnetic switch wherein reed contacts are normally disposed within a magnetic field in a position exerting neutral magnetic flux influence such that switch actuation occurs upon unbalancing the magnetic flux field. The switch may employ one or more magnets polarized and disposed in preselected alignment relative to the reed switch element which is physically positioned in a neutral portion of the combined magnetic flux field. More specifically, the present invention teaches a high reliability environment-proof switch that is completely sealed as to the external environment and actuatable by the movement of a permeable metal lever or proximate body that is movable to balance and unbalance the magnetic field thereby to selectively actuate the reed switch contacts.

Therefore, it is an object of the present invention to provide a magnetic switch that is immune to effects of the surrounding environment.

It is also an object of the present invention to provide a magnetic switch assembly that is insensitive to abrupt or relatively extreme temperature changes.

It is still further an object of the present invention to provide a proximity switch that is sensitive to the presence of a permeable metal body within a defined flux field.

Finally, it is an object of the present invention to provide a high reliability magnetic switch that is resistant to any detrimental effects of environmental surrounds and changes in ambient temperature.

Other objects and advantages of the invention will be evident from the following detailed description when read in conjunction with the accompanying drawings which illustrate the invention.

DETAILED DESCRIPTION OF THE INVENTION

Figure 1A:
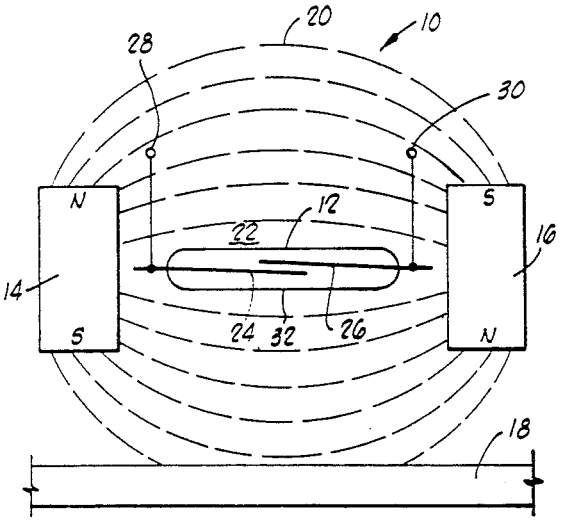
FIG. 1A is a schematic illustration of a magnetic switch constructed in accordance with the present invention.
Figure 1B:
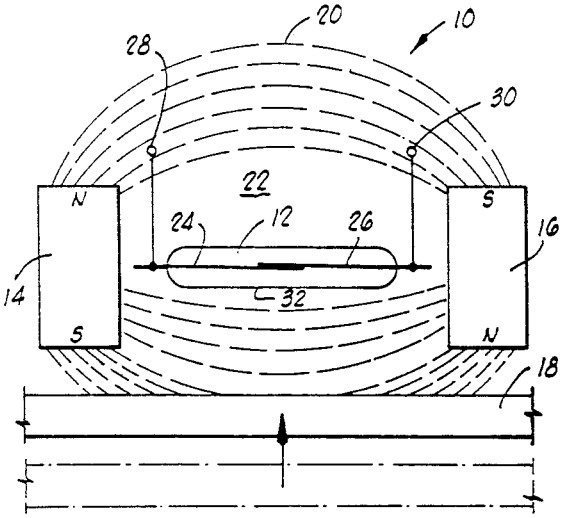
FIG. 1B is a schematic illustration of the switch of FIG. 1A when actuated.

Referring to FIGS. 1A and 1B, a reed switch 12 of switch assembly 10 is disposed at a neutral point, i.e., a neutral field axis, relative to magnets 14 and 16. The proximity switch assembly 10 is shown as being potentially responsive to such as a permeable metal segment 18 which in FIG. 1A is not proximate and is out of the flux field 20. Thus, the flux field is unaffected between the magnets 14 and 16 thereby to define a neutral field within the flux field mid-zone 22 such that insufficient magnetic force is present along the magnetic reed contacts 24, 26 to effect contact closure. The axis or direction of polarization of magnets 14 and 16 are perpendicular to the axis of the reed contacts 24,26 as they lie in the neutral zone 22.

FIG. 1B illustrates the effect on the flux field as the object 18 is moved into proximate position. Object 18 is an object of relatively high permeability such that its presence in the flux field tends to concentrate the flux intensity between the lower edges (opposite poles) of magnets 14 and 16 while unbalancing and moving the null field portion 22 upward thereby to place increased flux field across reed contacts 24 and 26. The increased flux field effects closure of the reed contacts 24, 26 to complete the circuits connected between switch output terminals 28 and 30. Removal of object 18 from the proximate position will once again allow the flux field 20 to go to the balanced condition with reed contacts 24 and 26 open and free of influence from the magnetic field, as in FIG. 1A.

The reed switch 12 may be formed in conventional manner with reed contacts 24 and 26 formed of ferromagnetic material such as No. 52 nickle-iron alloy which is annealed to increase permeability, and copper strike contacts with rhodium plating is applied to assure maximum electrical contact. The contacts 24 and 26 are hermetically sealed within a tubular glass envelope 32 and external contacts 28 and 30 are connected to respective reed members 24 and 26. The magnets 14 and 16 may be formed from any of a number of ferromagnetic materials but it is preferred to use ceramic magnets such as magnet material that is referred to as barium ferrite ceramic. There is also a suitable barium ferrite magnet having a softer binder that is referred to as PLASTIFORM TM. The ceramic magnets are characterized by high ferromagnetic strength and easy polarization control as the magnets can be polarized variously across selected dimensions of the material. While such ceramic magnets may be sensitive to temperature changes, this detriment is eliminated due to the fact that magnets function in balanced relationship at all times and each is subjected to the same external forces and effects.

Figure 2:
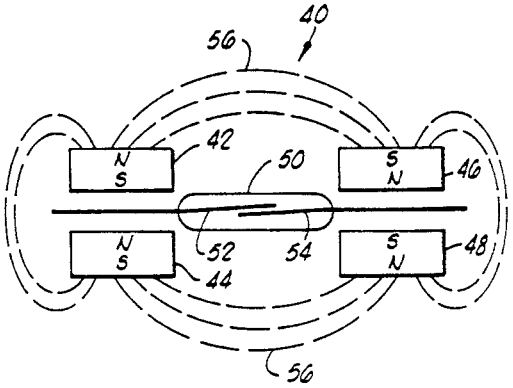
FIG. 2 is a schematic illustration of an alternative form of balanced flux field magnetic switch.

FIG. 2 shows a reed switch assembly 40 that utilizes four magnets 42, 44, 46 and 48 arrayed as oppositely polarized pairs and disposed in balanced relationship to a reed switch 50 having reed contacts 52 and 54. The oppositely polarized magnet pairs create a major flux field 56 which defines a magnetically neutral area along the field axis or position of reed switch 50.

Figure 3:
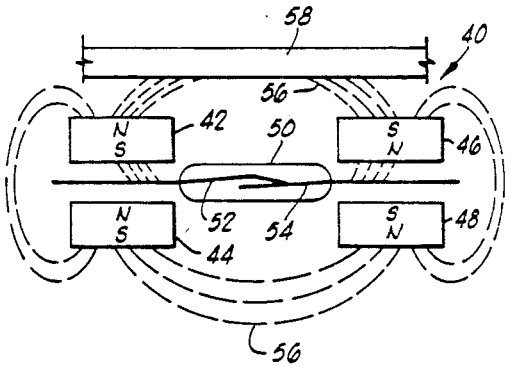
FIG. 3 is a schematic illustration of the switch of FIG. 2 when actuated in response to the unbalanced flux field condition.

FIG. 3 illustrates the situation wherein a metal object 58 comes proximate to switch assembly 40 entering the flux field 56 and intensifying the more local flux field by increasing permeability thereby to unbalance a portion of the field through reed switch 50 to close reed contacts 52 and 54. Thus, with entry of the detected object 58 into the flux field, the field is unbalanced so that the axial position of reed switch 50 is no longer neutral and the reed contacts 52, 54 respond with closure.

The balanced flux field type of magnetic switch is susceptible of many different designs using from one to several magnetic elements as will be further described.

Figure 4:
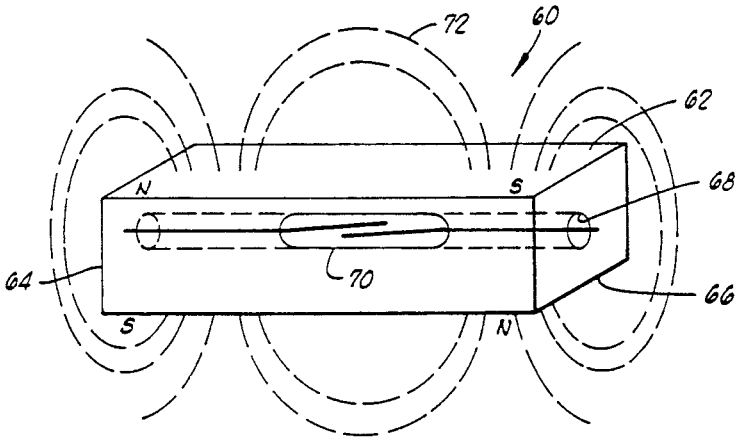
FIG. 4 is a schematic drawing of yet another form of balanced flux field switch configuration.

FIG. 4 illustrates another form of balanced magnetic switch 60 that consists of an elongated block of ferrite ceramic magnet material 62 that is oppositely magnetically polarized (laterally) through opposite ends 64 and 66. A central hole 68 is formed through the longitudinal axis of the magnet material 62 and a magnet reed switch 70 is suitably secured centrally therein. The opposite end magnetic polarizations are induced in order to set up a balanced flux field 72 which establishes a central neutral zone normally at the position of reed switch 70, i.e., the central axial interior of magnetic body 62. Under influence of a proximate object (not shown) positioned sufficiently within flux field 72, the magnetic field is unbalanced and the reed contacts of magnetic reed switch 70 are closed to complete the circuit.

Figure 5A:
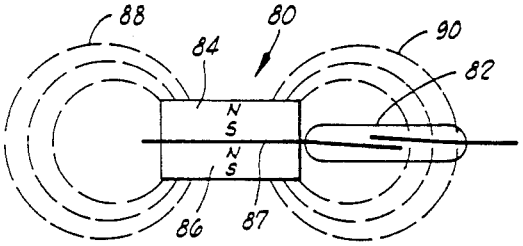
FIG. 5A illustrates still another form of balanced flux field switch configuration.
Figure 5B:
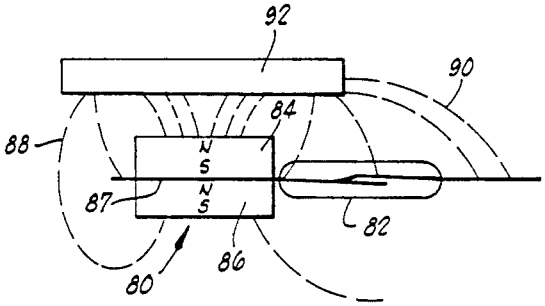
FIG. 5B illustrates the proximity actuation of the switch of FIG. 5A.

FIGS. 5A and 5B illustrate another alternative form of balanced flux field magnetic reed switch 80, a type which is susceptible of considerable miniaturization as will be further described. In this case, a reed switch 82 is aligned with the center of a north/south polarized pair of magnet bodies 84 and 86, joined along interface 87, which set up opposite flux fields 88 and 90. The reed switch 82 is positioned in alignment with interface 87 in the neutral central zone of the one flux field 90 so that no flux is encountered to effect reed switch closure. A proximate object 92 then enters the flux field 88–90 to unbalance the distribution of lines of force such that sufficient magnetism is exerted through the reed contacts of magnetic reed switch 82 to effect closure as in FIG. 5B. As in previous cases, once an object enters the flux field and disturbs or shifts the original null point, the reed contacts respond with closure.

Figure 6A:
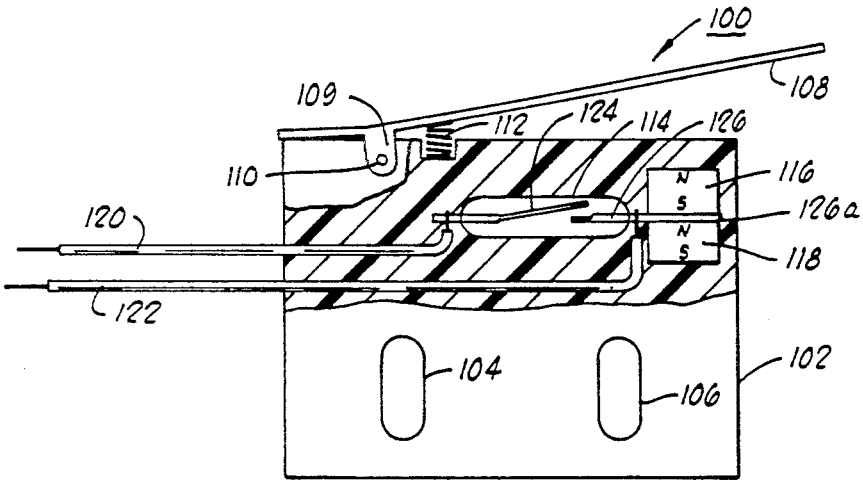
FIG. 6A is a view in side elevation with parts shown in cutaway of a proximity switch utilizing the switch configuration of FIG. 5A.
Figure 6B:
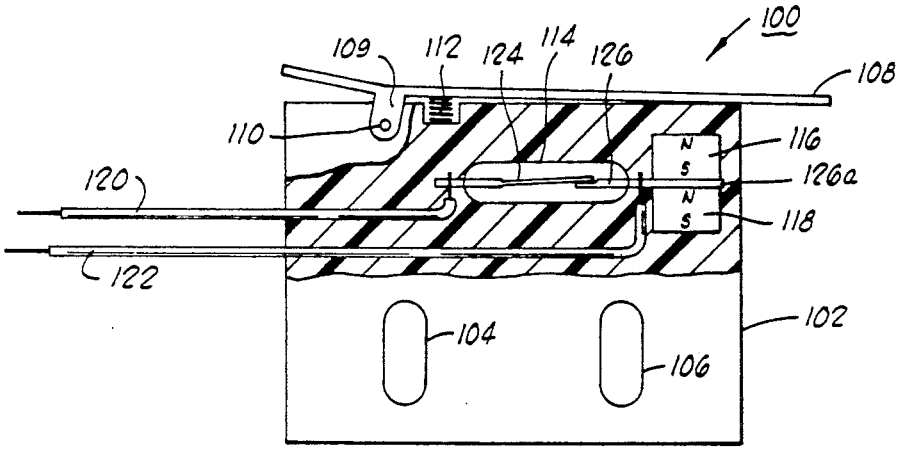
FIG. 6B is a view illustrating the switch closure of the switch of FIG. 6A.

FIGS. 6A and 6B illustrate a type of proximity switch 100 that utilizes the magnetic configuration of FIG. 5A. The proximity switch 100 is entirely insulated from any materials or effects of the environmental surrounds, and the switch is not affected by temperature changes due to the fact that all components will be equally influenced. The body of the switch 102 is molded from bakelite or other suitable potting compound to define mounting screw slots 104 and 106. An actuating arm 108 formed of high permeability material and having a pivot flange 109 is pivotally mounted by means of a pivot post 110 along the one edge of switch body 102. A compression spring 112 is secured as by proper seating between a portion of sensing arm 108 and switch body 102 to continually urge arm 108 outward into the nonactuation position.

The switch configuration consisting of a magnetic reed switch 114 and balanced magnets 116 and 118 (similar to FIG. 5) is molded within switch body 102 proximate the edge adjacent to the actuating arm 108. Electrical contact is made by external leads 120 and 122 which are molded for entry into body 102 for connection to opposite reed contacts 124 and 126. The ceramic magnets 116 and 118 are similarily polarized and stacked on opposite sides of reed contact 126 in the magnetic field neutral field position such that the reed contacts are open when switch arm 108 is in its upward position (FIG. 6A).

When switch arm 108 is depressed as by an engaged object, sensed object or other force, the flux field neutral position is altered such that flux is then present to close reed contacts 124 and 126 to complete the external circuit on leads 120 and 122. With removal of the force on actuating arm 108, the spring 112 urges arm 108 back outward into the normal open position with neutral flux field position across the reed contacts 124 and 126. It may be noted too that reed member 126 extends into physical contact and forms the interface 126A between the respective magnets 116 and 118.

Figure 7:
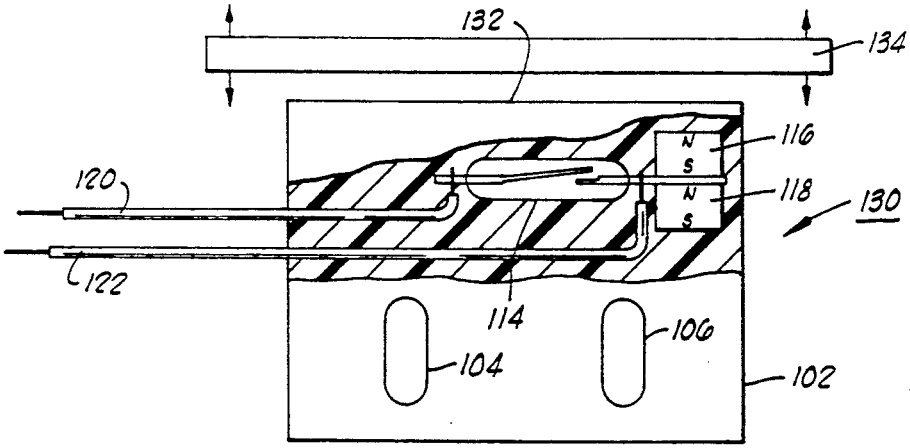
FIG. 7 is a view in side elevation of a proximity switch such as that of FIG. 5A when adapted for sensing proximate permeable objects.

FIG. 7 shows a similar type of environment-proof switch 130 as it might be utilized for sensing proximity of some permeable object adjacent the edge 132. Switch 130 is the same as switch 100 of FIG. 6 with the exception that it does not include the actuation arm 108 and connecting pivot assembly. Switch assembly 130 is utilized by positioning the edge surface 132 adjacent a surveillance point for detecting proximate positioning of a permeable object 134.

Figure 8:
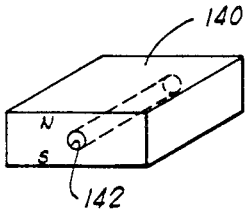
FIG. 8 is a perspective view of a magnet assembly that may be utilized in the present invention.

FIG. 8 illustrates a desirable fabrication technique wherein a ceramic body, 140 polarized magnetically as shown, may then be formed with a hole 142 formed therethrough in the flux null point or axis position. The magnetic reed switch may then be suitably potted or otherwise secured within hole 142 to form an integral magnetic proximity switch such as that of FIG. 4.

Figure 9:
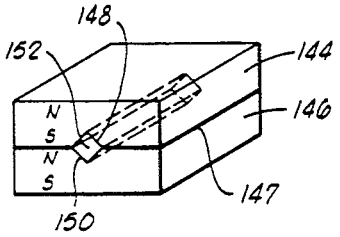
FIG. 9 is a perspective view of another magnet assembly that may be utilized in the present invention.

FIG. 9 illustrates another fabrication technique wherein a pair of similarly polarized magnetic bodies 144 and 146 joined at interface 147 are formed with a groove, e.g. a right angle groove, centrally across mating surfaces of interface 147. Thus, the south polarized surface of magnet 144 is formed with a groove 148 and the north polarized surface of magnet 146 is formed with a mating groove 150 such that magnets 144 and 146 may be joined to define a square channel 152 through the magnet assembly in a null point position.

Figure 10:
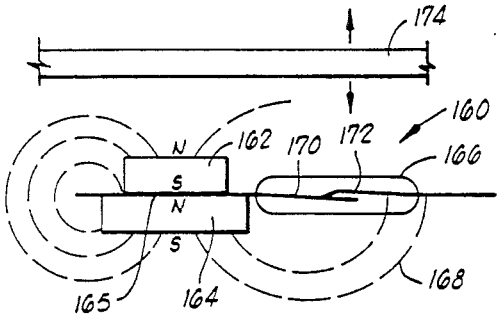
FIG. 10 is a schematic illustration of another form of balanced flux field magnetic switch in a normally closed mode.
Figure 11:
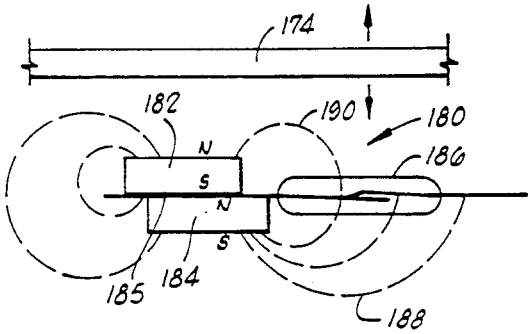
FIG. 11 is a schematic illustration of still another form of normally closed switch configuration.

FIG. 10 illustrates another form of magnetic switch assembly 160 which utilizes unequal but similarily polarized magnets 162 and 164 joined with interface 165 in alignment with reed switch 166 to provide a normally closed reed switch. The magnets are similarily polarized and aligned but the magnet 162 is of smaller size than the magnet 164 and the magnetic field through reed switch 166 is unbalanced such that the lower magnet 164 and portion of flux field 168 will effect closure of the reed contacts 170 and 172. A proximate object 174 may then be brought towards magnet 162 to increase permeability and flux field therefrom such that at a selected point the magnetic field effect on reed switch 166 becomes balanced and the reed contacts 170 and 172 open.

FIG. 9 illustrates yet another form of normally closed magnetic reed switch 180 which achieves normal closure by utilizing equal size and strength magnets 182 and 184 aligned in polarity but laterally displaced one to the other along interface 185. Thus, the magnet 182 is displaced further away from reed switch 186 than the lower magnet 184 such that the lower flux field portion 188 is more intense and effects closure of the reed contacts in the normal position. As the proximate object 174 moves sufficiently close, the upper flux field 190 is intensified sufficiently to place the flux null position at the reed switch 186 thereby to open the reed contacts. Such displacement as that of magnets 182 and 184 may be used for biasing or to make a normally closed proximity switch assembly that would be deoperated with approach of magnetic material or a proximate object 174.

Figure 12:
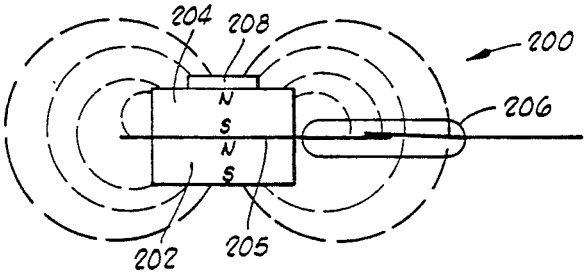
FIG. 12 is a schematic illustration of a balanced flux field magnetic switch including a normal closed biasing segment.

FIG. 12 illustrates still another form of magnetic switch assembly 200 which utilizes equal size and polarity of aligned magnets 202 and 204 in combination with magnetic reed switch 206. A small portion of magnetic material 208 is then added to the surface of magnet 204 to provide a biasing effect. The bias magnet 208 has the effect of increasing flux intensity thereby to displace the magnetic field null position proportionately and, if the bias effect is sufficient, the switch assembly 200 may become a normally closed assembly responsive to a proximate object to balance the field and open the switch contacts.

The foregoing discloses a novel form of magnetic switch assembly that functions in response to changes in the flux field and is particularly adaptable for proximity sensing. The device is highly resistant to temperature change effects due to the fact that all components operate in a balanced manner and all are equally effected by any changes in temperature. The particular type of switch is also readily adaptable for weather-proof or other forms of insulated or isolated switching due to the fact that switch components may be readily sealed separate from actuating components in entirely isolated disposition.

Changes may be made in combination and arrangement of elements as heretofore set forth in the specification and shown in the drawings; it being understood that changes may be made in the embodiments disclosed without departing from the spirit and scope of the invention as defined in the following claims.

The embodiments of the invention in which an exclusive property or privilege is claimed are as follows:

I claim:

1. A magnetic switch actuatable by proximity of a permeable object, comprising:

first and second bars of magnet material having interface surfaces joined in overlay with each having a mating groove formed longitudinally on the respective interface surfaces thereby to form a bore through the joined magnet material, said first and second bars forming a bar of magnet material having first and second ends and being oppositely polarized transversely through the first and second ends to form first and second axes of polarity and polarity neutral zone in alignment with said bore; and magnetic reed switch means having first and second ends aligned generally perpendicular to said axes of polarity and being normally open and disposed in said neutral zone;

wherein said permeable object presence in said magnetic force field shifts the neutral zone to place the reed switch means in a magnetic force field sufficient to actuate the reed switch means closed.

2. A magnetic switch actuatable by proximity of a permeable object, comprising:

first and second magnets of similar size and polarity joined at respective interface surfaces and positioned with said interface aligned with a switch axis, said magnets having respective north and south poles and defining respective axes of polarity while normally producing a magnetic force field having a polarity neutral zone;

first and second reed contacts of selected magnetic permeability; and means defining an elongated switch axis and having first and second ends for securing said reed contacts, said switch axis being aligned generally perpendicular to said axes of polarity with said reed contacts normally open and disposed in said neutral zone;

wherein said permeable object presence in said magnetic force field shifts the neutral zone to place the reed contacts sufficiently within a magnetic force field to actuate the contacts closed.

3. A switch as set forth in claim 2 wherein:

the first magnet is shifted relative to the second magnet on the interface to unbalance the magnetic force field and normally close the first and second reed contacts.

4. A switch as set forth in claim 5 wherein said at least one magnet means comprises:

first and second magnets of dissimilar size and same polarity joined at an interface and positioned with said interface aligned with said switch axis whereby the magnetic force field is unbalanced to normally close the first and second reed contacts.

5. A switch as set forth in claim 2 which further includes:

third magnetic means disposed adjacent to said first and second magnets to bias the magnetic field to a predetermined neutral zone position.

6. A switch means as set forth in claim 2 wherein:

said first and second magnets are formed from ceramic magnet material of the barium ferrite type.

7. A sealed proximity switch comprising:

an enclosed reed switch having first and second aligned reed contacts and external connecting leads;

at least one magnetic means defining an axis of polarity disposed adjacent said reed switch with said axis of polarity perpendicular to said first and second aligned reed contacts and producing a magnetic force field having a neutral zone at the position of said reed switch;

a molding compound enclosing said reed switch and magnet means to form a switch body extending said external connecting leads; and a switch arm of permeable material movably secured on said switch body for movement through the magnetic force field to control closure of said reed contacts.

8. A switch as set forth in claim 7 wherein: said magnetic means is ceramic magnet material.

9. A switch as set forth in claim 7 wherein said enclosed reed switch comprises:

a hermetically sealed, elongated enclosure having first and second ends and an axial chamber;

a first reed contact of permeable conductive material secured through the first end along said chamber;

a second contact of permeable conductive material secured through the second end along said chamber.

10. A switch as set forth in claim 7 wherein said at least one magnetic means comprises:

first and second magnets of same size and polarity joined at an interface in polarity aiding alignment and positioned with said interface aligned generally with said reed contacts.

11. A switch as set forth in claim 9 wherein said at least one magnetic means comprises:

first and second magnets of same size and polarity joined at an interface in polarity aiding alignment and positioned with said interface aligned with one of said first and second reed contacts.

12. A switch as set forth in claim 11 wherein:

said magnet interface and reed contact are in physical contact.

13. A switch as set forth in claim 11 wherein said switch arm comprises:

an actuating arm having first and second ends with the first end pivotally attached to said switch body and the second end extending to an area adjacent the switch body where the magnetic force field is present; and spring means urging said actuating arm away from the switch body and out of said magnetic force field.

14. A magnetic switch actuatable by proximity of a permeable object, comprising:

magnet means defining an axis of polarity and normally producing a magnetic force field having a polarity neutral zone consisting of a bar of magnet material having first and second ends and being oppositely polarized transversely through the first and second ends, and having an axial bore formed longitudinally between said first and second ends; and magnetic reed switch means having first and second ends and being disposed in said axial bore aligned generally perpendicular to said axis of polarity, said switch means being normally open and disposed in said neutral zone;

wherein said permeable object presence in said magnetic force field shifts the neutral zone to place the reed switch means in a magnetic force field sufficient to actuate the reed switch means closed.

* * * * *